US005971212A

United States Patent [19]

Drader

[11] Patent Number: 5,971,212

[45] Date of Patent: Oct. 26, 1999

[54] APPARATUS FOR WELDING THERMOPLASTICS BY HIGH PRESSURE INJECTION

[76] Inventor: Clarence H. Drader, 52073 Hwy. 21, Sherwood Park, Alberta, Canada, T8B 1J4

[21] Appl. No.: 08/958,287

[22] Filed: Oct. 27, 1997

[51] Int. Cl.[6] ..... B67D 5/62

[52] U.S. Cl. ..... 222/146.5; 222/391; 226/128

[58] Field of Search ..... 222/146.5, 391; 228/52, 53; 226/127, 128, 162–167

[56] References Cited

U.S. PATENT DOCUMENTS

| | | | |
|---|---|---|---|
| 311,785 | 2/1885 | Reynolds . | |
| 2,254,521 | 9/1941 | Gardner . | |
| 2,261,378 | 11/1941 | Jelinek et al. . | |
| 2,275,269 | 3/1942 | O'Loughlin . | |
| 2,604,064 | 7/1952 | Sefton . | |
| 2,821,947 | 2/1958 | Von Knauf | 226/128 |
| 2,848,969 | 8/1958 | Shapiro | 226/128 |
| 3,101,689 | 8/1963 | Hammond et al. . | |
| 3,314,574 | 4/1967 | Longval et al. | 222/146.5 |
| 3,743,142 | 7/1973 | Elliot et al. | 222/146.5 |
| 3,774,817 | 11/1973 | Whittaker . | |
| 3,964,644 | 6/1976 | Wallace | 222/146.5 |
| 4,090,643 | 5/1978 | Wilkinson, Jr. et al. | 222/146.5 |
| 4,289,257 | 9/1981 | Herb et al. | 222/146.5 |
| 4,378,076 | 3/1983 | Stirnweiss | 222/146.5 |
| 4,379,516 | 4/1983 | Barlogis . | |
| 4,513,886 | 4/1985 | Price . | |
| 4,523,705 | 6/1985 | Belanger et al. . | |
| 4,637,745 | 1/1987 | Speisebecher et al. | 222/146.5 X |
| 4,711,746 | 12/1987 | Drader . | |
| 4,916,289 | 4/1990 | Suhanek | 226/127 X |
| 4,951,846 | 8/1990 | Oster et al. . | |

FOREIGN PATENT DOCUMENTS 848967 6/1960 United Kingdom .

OTHER PUBLICATIONS

Schematic drawing of "Drader Injectiweld" dated 1988 (1 page).

Brochure of Drader Manufacturing Industries Ltd. entitled "Drader Injectiweld" dated 1986 (4 pages).

Pamphlet of Drader Manufacturing Industries Ltd. entitled "Drader Injectiweld" dated 1988 (1 page).

Drader Injectiweld brochure entitled "The Quality Plastic Welding System" dated 1997 (4 pages).

*Primary Examiner*—Kevin P. Shaver
*Attorney, Agent, or Firm*—Terrance N. Kuharchuk

[57] ABSTRACT

An apparatus for advancing a thermoplastic rod to a heated chamber. A housing, having a first end for communication with the chamber and a second end, receives the rod. A feeding mechanism applies an advancement force to the rod at a first location in a first direction towards the chamber. A retaining mechanism applies a retaining force to the rod at a second location in response to a force applied to the rod in a second direction opposite the first location. The rod is substantially supported within the housing from at least the first location to the first end. The retaining force is applied to the rod substantially about the entire circumference of the rod. The advancement force is applied to the rod at the first location between the first and second ends and the retaining force is applied to the rod at a second location between the first location and the second end.

26 Claims, 2 Drawing Sheets

APPARATUS FOR WELDING THERMOPLASTICS BY HIGH PRESSURE INJECTION

FIELD OF INVENTION

The present invention relates to an apparatus for advancing a rod comprised of a thermoplastic material to a heated chamber for injection therefrom under a relatively high pressure.

BACKGROUND OF INVENTION

U.S. Pat. No. 4,711,746 issued Dec. 8, 1987 to Drader is directed at a process, and an associated device, for welding thermoplastic by high pressure injection of molten plastic into the area to be welded. Although the process has been found to be relatively efficient and effective, the disclosed device tends to be quite expensive to manufacture and maintain.

In particular, the Drader device comprises a heated barrel having an internal chamber and a nozzle forming a restrictive orifice outlet. Plastic filler rod is forced into the chamber by drive rolls in order to generate a high pressure within the internal chamber of about 2500 psi. The molten plastic is thus forcefully ejected from the internal chamber through the orifice outlet. The drive rolls are actuated by an air driven ratchet wrench having an output shaft which is connected to a worm, which in turn meshes with a worm gear. The worm gear is connected to a first drive roll, which drivingly engages a second drive roll such that the drive rolls rotate together. The rod is gripped between the drive rolls and advanced towards the internal chamber through an inlet of the barrel.

Thus, Drader discloses a complex feed system for the rod, which tends to render the device relatively uneconomical to both produce and maintain. Further, given the specific configuration of the drive rolls, a spaced distance or gap exists between the inlet of the barrel and the location at which the rod is gripped between the drive rolls. As a result, the rod is not substantially supported between the inlet and the drive rolls, which may result in buckling of the rod when generating a high pressure in the internal chamber.

As well, although the system of gears and drive rolls in Drader may inadvertently inhibit movement of the rod rearward away from the barrel inlet, to a certain extent, the drive rolls and gears are not specifically designed for this function and may therefore provide a relatively inefficient mechanism for accomplishing this task. A separate or distinct means or mechanism for inhibiting this rearward movement of the rod is neither discussed nor disclosed.

Further devices for dispensing an adhesive are disclosed by U.S. Pat. No. 3,774,817 issued Nov. 27, 1973 to Whittaker and U.S. Pat. No. 4,379,516 issued Apr. 12, 1983 to Barlogis. Neither of these patents specifically discuss or disclose the use of their respective devices for high pressure injection of thermoplastics. Furthermore, each of these patents discloses a relatively complex device, which is unsuitable for injecting a molten thermoplastic under a relatively high pressure given the specific structure of the device.

Whitaker discloses a feed mechanism for advancing a rod of adhesive from a guide tube into a premelt canal section, which communicates with a heated reservoir. The feed mechanism comprises a gripping assembly and a complex pneumatic assembly, which apply a force to the rod at the location of the guide tube in order to advance the rod forwards into the premelt canal. The guide tube and the premelt canal are spaced apart to provide an "air gap" therebetween for dissipation of heat from the premelt canal and for insulation of the guide tube. As a result, the rod is unsupported between the guide tube and the premelt canal, which may result in buckling of the rod in the event a force is applied to the guide tube sufficient to generate a high pressure within the heated reservoir. Furthermore, the device attempts to avoid the generation of high pressures by specifically allowing for a slight rearward or return movement of the rod following its forward advancement into the premelt canal. This rearward movement is allowed to relieve pressure in the premelt canal and thereby prevent the flow of molten adhesive out of the air gap.

Apart from the permitted rearward movement, any tendency of the rod to move rearwards in Whittaker, away from the premelt canal, is inhibited by a finger stop. The finger stop provides a slender projection which passes through a slot in the guide tube for engaging the rod. A single sharpened end or point of the projection engages the rod at a single point on the circumference of the rod such that only a limited force may be applied by the finger stop to inhibit the rearward movement. The finger stop may therefore provide a relatively inefficient and ineffective mechanism for inhibiting rearward movement of the rod in the event a relatively strong rearward force is applied to the rod.

Barlogis similarly discloses a device for advancing an adhesive rod forwards to a heated chamber by the application of a force to the rod. The force may be applied manually, pneumatically or by a camming mechanism. In each of these cases, the rod is not substantially supported between the location of the application of the force and the heated chamber, which may result in buckling of the rod in the event a high pressure is sought to be generated in the heated chamber. Furthermore, the device specifically attempts to avoid the generation of undesirable high pressures in the heated chamber by providing a biased return element which brings the rod rearward when the forward force is no longer exerted in order to avoid any untimely dispensing of the adhesive through the heated chamber.

Finally, U.S. Pat. No. 4,513,886 issued Apr. 30, 1985 to Price discloses an apparatus for feeding an adhesive rod towards a melt chamber. This patent does not specifically discuss or disclose the use of the apparatus for high pressure injection of a thermoplastic. Furthermore, this patent discloses a relatively complex device, which may render the device relatively uneconomical to produce and maintain.

In particular, Price discloses a fixed tube which communicates with the melt chamber. A guide tube slidably fits within the fixed tube. Further, the guide tube is secured to a lead-in tube which is clamped inside a support tube. The rod extends from an upstream end through the lead-in tube, into the guide tube and then into the fixed tube to a downstream end. The feed mechanism comprises a feed jaw which projects through slots in the support and lead-in tubes for engagement with the rod. To advance the rod, the jaw engages the rod and the jaw, along with the support, lead-in and guide tubes, are advanced forward such that the guide tube passes inside the fixed tube.

Upon retraction, a retaining jaw grips the rod to prevent its return movement with the feed mechanism. The retaining jaw projects through slots in the fixed tube for engagement with the rod. As a result, the jaw inhibits rearward movement by engagement of the rod at a single point or defined location on the rod such that only a limited force may be applied by the jaw. The retaining jaw may therefore provide a relatively inefficient and ineffective mechanism for inhibiting rearward movement of the rod in the event a relatively strong rearward force is applied to the rod.

Further, the retaining jaw of Price is located adjacent the downstream end of the rod, while the feed jaw is located adjacent the upstream end of the rod such that the rod is pushed through the retaining jaw by the feed jaw. As a result, if the retaining jaw fails to release the rod upon advancement of the feed jaw towards the melt chamber, the feed mechanism will compress the rod against the retaining jaw, which is likely to cause damage to the internal structure of the device. The greater the force applied to advance the rod, the greater the likelihood of resulting damage to the structure of the device.

There is therefore a need in the industry for an improved apparatus for use in welding thermoplastics which is relatively simple in design such that it may be economically manufactured and maintained, as compared to similar known apparatuses. More particularly, there is a need for an apparatus for advancing a rod comprised of a thermoplastic material to a heated chamber for injection therefrom under pressure. Further, there is a need for the apparatus to be capable of applying an advancement force to the rod in a first direction towards the heated chamber which is sufficient to provide a relatively high injection pressure within the heated chamber, as compared to known devices for performing a similar function.

In addition, there is a need in the industry for a retaining mechanism for the improved apparatus. In particular, there is a need for an improved retaining mechanism which inhibits the movement of the rod in a second direction opposing the first direction, which is relatively simple in its structure as compared to known retaining mechanisms.

SUMMARY OF INVENTION

The present invention relates to an apparatus for use in welding thermoplastics which is relatively simple in design such that it may be economically manufactured, as compared to similar known apparatuses. More particularly, the present invention relates to an apparatus for advancing a rod comprised of a thermoplastic material to a heated chamber for injection therefrom under pressure. Preferably, the apparatus is capable of applying an advancement force to the rod in a first direction towards the heated chamber which is sufficient to provide a relatively high injection pressure within the heated chamber, as compared to known devices for performing a similar function. In order to provide a relatively high injection pressure, the rod of thermoplastic material is preferably substantially supported by the apparatus between the location of the application of the advancement force to the rod and the forward end of the apparatus which communicates with the heated chamber. More preferably, the rod is substantially supported between the location of the application of the advancement force and the heated chamber.

Further, the present invention relates to a retaining mechanism for the apparatus of the within invention. In particular, the invention further relates to a retaining mechanism for inhibiting the movement of the rod in a second direction opposing the first direction. Preferably, the retaining mechanism applies a retaining force to the rod in response to a force applied to the rod in the second direction. In addition, the retaining mechanism preferably applies the retaining force to the rod substantially about the entire circumference of the rod. Finally, preferably, the advancement force is applied to the rod by the apparatus at a first location between the heated chamber and one end of the apparatus, which communicates with the heated chamber, and the retaining mechanism applies the retaining force to the rod at a second location between the first location and the other end of the apparatus.

In a first aspect of the invention, the invention is comprised of an apparatus for advancing a rod comprised of a thermoplastic material to a heated chamber for injection therefrom under pressure, the apparatus comprising:

(a) a housing for receiving the rod having a first end for communication with the heated chamber, a second end and a bore extending therethrough from the first end to the second end;

(b) a feeding mechanism, associated with the housing, for selectively engaging the rod within the housing such that an advancement force is applied to the rod at a first location in a first direction towards the heated chamber in order to advance the rod in the first direction, wherein the advancement force is sufficient to provide an injection pressure within the heated chamber; and (c) a retaining mechanism, associated with the housing, for inhibiting the movement of the rod in a second direction opposite the first direction, wherein the retaining mechanism applies a retaining force to the rod at a second location substantially about the entire circumference of the rod in response to a force applied to the rod in the second direction;

wherein the rod is substantially supported within the housing from at least the first location on the rod to the first end of the housing.

In the first aspect, the advancement force and the retaining force may be applied respectively at any locations along the rod between the first and second ends of the housing. However, preferably, the feeding mechanism applies the advancement force to the rod at the first location between the first and second ends of the housing and the retaining mechanism applies the retaining force to the rod at a second location between the first location and the second end of the housing in response to a force applied to the rod in the second direction.

In a second aspect of the invention, the invention is comprised of an apparatus for advancing a rod comprised of a thermoplastic material to a heated chamber for injection therefrom under pressure, the apparatus comprising:

(a) a housing for receiving the rod having a first end for communication with the heated chamber, a second end and a bore extending therethrough from the first end to the second end;

(b) a feeding mechanism associated with the housing, for selectively engaging the rod at a first location between the first and second ends of the housing such that an advancement force is applied to the rod at the first location in a first direction towards the heated chamber in order to advance the rod in the first direction, wherein the advancement force is sufficient to provide an injection pressure within the heated chamber; and (c) a retaining mechanism, associated with the housing, for inhibiting the movement of the rod in a second direction opposite the first direction, wherein the retaining mechanism applies a retaining force to the rod at a second location between the first location and the second end of the housing in response to a force applied to the rod in the second direction;

wherein the rod is substantially supported within the housing substantially from at least the first location on the rod to the first end of the housing.

In the second aspect, the retaining mechanism may apply the retaining force to the rod in any manner permitting the functioning of the retaining mechanism. For instance, the retaining force may be applied at a single point or defined location about the circumference of the rod. However, preferably, the retaining force is applied substantially about the entire circumference of the rod.

In both the first and second aspects of the invention, the first end of the housing preferably communicates with the heated chamber such that the rod is continuously substantially supported therebetween. Thus, in the preferred embodiment, the rod is substantially continuously supported from at least the first location on the rod, at which the advancement force is applied, to the heated chamber. In addition, the rod may also be substantially supported from the second end of the housing to the first location.

Further, in the first and second aspects, the retaining mechanism may be comprised of any means, mechanism, structure or device capable of inhibiting the movement of the rod in the second direction. However, in the preferred embodiment, the retaining mechanism is comprised of a tubular member having a first end, a second end and a bore extending therethrough for receiving the rod, wherein the tubular member is oriented such that the rod may advance through the tubular member in the first direction from the second end to the first end towards the heated chamber. Further, preferably, the rod is substantially supported in the tubular member substantially from the first to the second end of the tubular member.

Any form or manner of tubular member may be used in the within apparatus. However, the tubular member preferably defines at least one longitudinal slit extending from the first end towards the second end of the tubular member, wherein the tubular member is inwardly biased such that the rod is received snugly within the bore of the tubular member and such that, upon the application of a force to the rod in the second direction, at least the first end of the tubular member exerts a pinching action on the rod in order to provide the retaining force. In addition, as indicated above, the tubular member preferably encompasses substantially the entire circumference of the rod such that the pinching action is exerted about substantially the entire circumference of the rod.

More preferably, the tubular member defines at least two longitudinal slits extending from the first end towards the second end of the tubular member such that at least two inwardly biased sections are formed at the first end of the tubular member for exerting the pinching action. In the preferred embodiment, the tubular member defines two longitudinal slits such that two inwardly biased sections are formed. Further, in the preferred embodiment, the first end of the tubular member is comprised of a forward edge, wherein the forward edge exerts the pinching action on the rod in order to provide the retaining force. However, the retaining force may be applied in any other suitable manner and by any other portion of the tubular member.

As well, the respective bores of the retaining mechanism and the housing may be aligned in any manner permitting the functioning of the apparatus as described herein. However, preferably, the bore of the retaining mechanism is substantially coaxial with the bore of the housing. Further, although the tubular member may communicate directly or indirectly with the housing in any manner permitting the rod to pass therebetween, preferably at least the first end of the tubular member extends into the bore of the housing at the second end of the housing.

In the first and second aspects of the invention, the advancement force must be sufficient to provide an injection pressure within the heated chamber. Preferably, the advancement force is sufficient to provide an injection pressure within the heated chamber of greater than about 1000 psi. More preferably, the advancement force is sufficient to provide an injection pressure of equal to or greater than about 2500 psi.

As well, in the first and second aspects, the feeding mechanism may be comprised of any means, mechanism, structure or device capable of selectively engaging the rod such that a sufficient advancement force may be applied to the rod. Preferably, the feeding mechanism reciprocates relative to the housing in the first direction towards the heated chamber and in the second direction away from the heated chamber, wherein the feeding mechanism selectively engages the rod such that upon movement of the feeding mechanism in the first direction the rod is gripped by the feeding mechanism and advanced towards the heated chamber with sufficient force to provide the injection pressure and such that upon movement of the feeding mechanism in the second direction the rod does not substantially move in the second direction.

In the preferred embodiment, the feeding mechanism comprises:

(a) a tube located within the housing for reciprocation within the housing, the tube comprising a first end, a second end and a bore extending from the first end to the second end of the tube for receiving the rod such that the rod is substantially supported within the bore from at least the first location on the rod to the first end of the tube; and (b) a jaw member comprising a gripping surface and a sliding surface, for camming engagement with the rod and for reciprocation with the tube such that the rod is gripped by the gripping surface as the feeding mechanism is moved in the first direction and such that the rod is engaged by the sliding surface as the feeding mechanism is moved in the second direction.

BRIEF DESCRIPTION OF DRAWINGS

Embodiments of the invention will now be described with reference to the accompanying drawings, in which.

DETAILED DESCRIPTION

Figure 1:
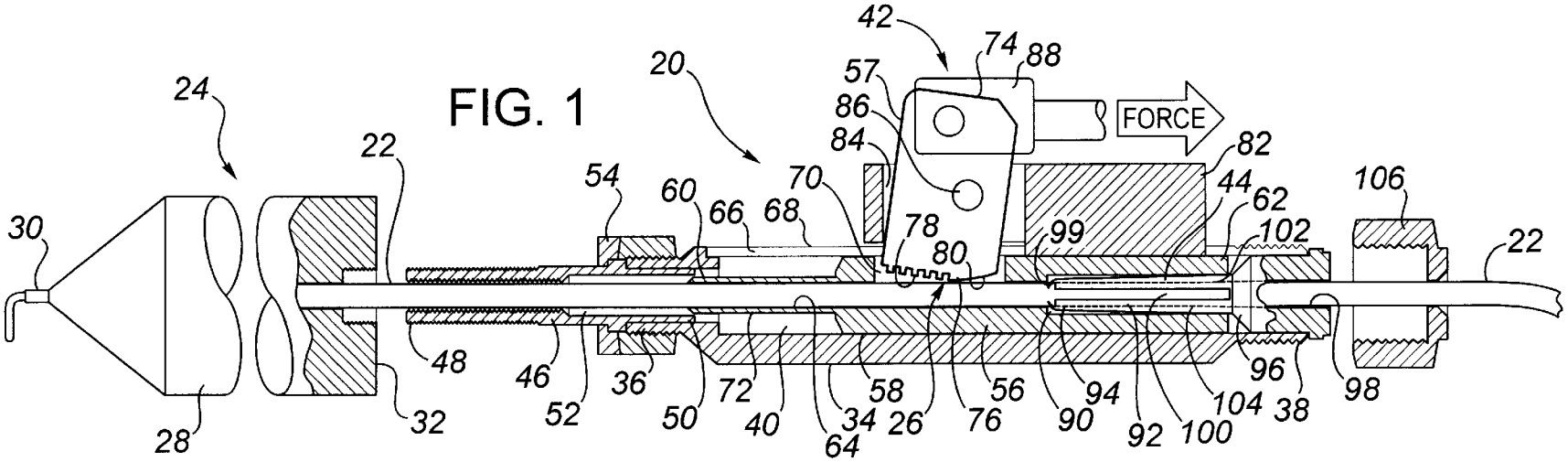
FIG. 1 is a side view of a preferred embodiment of the apparatus and a heated chamber, shown in longitudinal section, wherein a feeding mechanism of the apparatus is moved in a second direction away from the heated chamber.

Referring to FIGS. 1 through 4, the present invention is directed at an apparatus (20) for advancing a rod (22) comprised of a thermoplastic material to a heated chamber (24) for injection therefrom under pressure. More particularly, the apparatus (20) is for use for welding a thermoplastic workpiece. The rod (22) is advanced into the heated chamber (24) for melting such that a molten thermoplastic material may be injected from the heated chamber (24) into the area of the workpiece to be welded.

The rod (22) may be comprised of any known thermoplastic material such that the rod (22) is capable of melting to a substantially molten state upon its advancement by the apparatus (20) into the heated chamber (24). Thus, the thermoplastic material must be compatible with the temperature generated within the heated chamber (24) and its residence time within the heated chamber (24) in order that the rod (22) may be substantially melted therein for injection from the heated chamber (24), without causing any significant damage to the thermoplastic material.

Further, the rod (22) is preferably a continuous rod or the rod has a length such that the thermoplastic material is able to be advanced within the apparatus (20) on a relatively continuous or uninterrupted basis without requiring further lengths of the rod to be inserted therein. In other words, the length of the rod (22) is selected so that an operator may use the apparatus (20) without requiring any significant interruption of the welding process performed by the apparatus (20) in order to insert further thermoplastic rods (22). However any length of rod (22) may be used as long as the selected length is compatible with the dimensions of the apparatus (20) such that the apparatus (20) is capable of advancing the rod (22) therein in the manner described below.

Similarly, the rod (22) may have any cross-sectional dimensions and shape which are compatible with the elements of the apparatus (20). For instance, with respect to the cross-sectional shape of the rod (22), the rod (22) may be square, rectangular, oval, circular or any other shape as long as the apparatus (20) is designed to be compatible with such shape. However, for ease of use, and given the availability of such rods (22), the rod (22) is circular on cross-section in the preferred embodiment. Any conventional circular thermoplastic rod (22) may be used.

Further, the rod (22) may have any cross-sectional dimension, or diameter in the preferred embodiment, so long as the apparatus (20) is compatible therewith. However, preferably, the rod (22) has a relatively small diameter. A relatively small diameter, and thus a relatively small cross-sectional area, are preferred in order to reduce and minimize the force required to be exerted on the rod (22) in order to advance the rod (22) into the heated chamber (24) and produce the desired injection pressure within the heated pressure (24) for injection of the molten thermoplastic therefrom. In particular, as discussed further below, it is desirable that a relatively high injection pressure be provided within the heated chamber (24) in order to perform the welding process with the apparatus (20). In order to achieve such relatively high injection pressures, while reducing or minimizing the force to be applied to the rod (22) to advance the rod (22) into the heated chamber (24), the cross-sectional area of the rod (22) is preferably similarly reduced or minimized. In the preferred embodiment, the rod (22) has a diameter of about 5/32 inches.

However, a small diameter thermoplastic rod (22) tends to be relatively elastic and compressible and tends to be easily deformed under pressure. As a result, in the preferred embodiment, the apparatus (20), and the dimensions of its particular elements as described below, are designed and selected such that the rod (22) is substantially supported within the apparatus (20) at least between a first location (26), at which an advancement force is applied to the rod (22) to advance the rod (22) to the heated chamber (24), and the end of the apparatus (20) through which the rod (24) is advanced or expelled from the apparatus (20) towards the heated chamber (24). More preferably, the rod (22) is substantially supported between the first location and the heated chamber (24). Thus, any tendency of the rod (22) to buckle or deform within the apparatus (20) upon the application of the advancement force is minimized or reduced. As a result, the desired injection pressure may more readily be produced in the heated chamber (24).

The heated chamber (24) may be comprised of any conventional heated chamber for melting thermoplastic material, which is compatible with the selected rod (22) to be used in the apparatus (20). For instance, the heated chamber (24) must provide a sufficient or suitable temperature and a sufficient or suitable residence time for the rod (22) within the heated chamber (24) such that the rod (22) may be substantially melted therein, without causing any significant damage to the thermoplastic material.

Preferably, referring to FIG. 1, the heated chamber (24) is comprised of a barrel (28) forming an internal chamber (not shown) therein. The internal chamber has a restrictive orifice outlet (30) at one end for expelling the molten thermoplastic and a barrel inlet (32) at the other end for receiving the rod (22) into the barrel (28). The barrel (28), and in particular the internal chamber and the restrictive orifice outlet (30), are heated to a temperature sufficient to melt or plasticize the thermoplastic rod (22) and to maintain its molten state until it is expelled from the outlet (32). In the preferred embodiment, the barrel (28) is heated to a temperature of between about 350 to 600 degrees Fahrenheit.

As indicated, the apparatus (20) applies an advancement force to the rod (22) at the first location which is sufficient to provide a relatively high injection pressure within the heated chamber (24), as compared to other conventional devices. Preferably, the advancement force is sufficient to provide an injection pressure within the heated chamber of greater than about 1000 psi. In the preferred embodiment, the advancement force is sufficient to provide an injection pressure of equal to or greater than about 2500 psi. However, any injection pressure may be provided which is able to eject or expel the molten thermoplastic material from the restrictive orifice outlet (30) such that a competent weld of the thermoplastic workpiece may be produced.

The apparatus (20) may be comprised of any conventional material compatible with the intended use of the apparatus (20). Further, the apparatus (20), and the individual elements of it, may be machined or otherwise formed into their desired shapes or configurations by any suitable conventional processes or devices.

The apparatus (20) of the within invention is comprised of a housing (34) for receiving the rod (22). The housing (34) has a first end (36) for communicating with the heated chamber (24) and a second opposing end (38). A bore (40) extends through the housing (34) from the first end (36) to the second end (38). When using the apparatus (20), the rod (22) passes through the bore (40) from the second end (38), where it is inserted into the housing (34), to the first end (36) and towards the heated chamber (24). The rod (22) is substantially supported within the housing (34) from at least the first location (26) on the rod (22), at which the advancement force is applied, to the first end (36) of the housing (34). Further, the rod (22) may be substantially supported within the housing (34) substantially between the first and second ends (36, 38) of the housing (34).

As well, the first end (36) of the housing (34) preferably communicates with the heated chamber (24) such that the rod (22) is continuously substantially supported therebetween. Any conventional structure, device or mechanism may be used for directly or indirectly connecting the first end (36) to the heated chamber (24) such that communication therebetween is permitted. However, in the preferred embodiment, the apparatus (20) is further comprised of an entry tube (46). The entry tube (46) has a first end (48), for connection to the barrel inlet (32) of the heated chamber (24), and a second end (50), for connection to the first end (36) of the housing (34).

The connections, between the first and second ends (48, 50) of the entry tube (46) and the barrel inlet (32) and the first end (36) of the housing (34) respectively, may be made by any conventional device, method or process. However, in the preferred embodiment, the connections are threaded connections. In particular, the second end (50) of the entry tube (46) is sized and shaped to closely fit within the bore (40) of the housing (34) at the first end (36) of the housing (34). The second end (50) of the entry tube (46) is then retained in position by a retaining nut (54) which is threaded onto the first end (36) of the housing (34).

Further, The entry tube (46) also defines a bore (52) therethrough, extending between the first and second ends (48, 50), for receiving the rod (22). Preferably, the bore (52) is sized and shaped to substantially support the rod (22) therein between the first and second ends (48, 50) of the entry tube (46). Thus, the rod (22) is continuously substantially supported between the first end (36) of the housing (34) and the heated chamber (24).

The apparatus (20) is further comprised of a feeding mechanism (42) and a retaining mechanism (44), which are both associated with the housing (34). The feeding mechanism (42) selectively engages the rod (22) such that the advancement force is applied to the rod (22) at the first location (26) in a first direction towards the heated chamber (24) in order to advance the rod (22) in the first direction. The advancement force, as described above, is sufficient to provide the injection pressure within the heated chamber (24).

The first location (26), at which the advancement force is applied, may be located at any location along the length of the rod (22) which will result in the rod (22) being advanced towards the heated chamber (24). However, preferably, the advancement force is applied to the rod (22) at a location within the housing (34). Thus, the first location (26) is located between the first and second ends (36, 38) of the housing (34).

Any conventional feeding mechanism (42) may be used which is capable of selectively engaging the rod (22) and applying the advancement force at the first location (26) in the first direction. However, in the preferred embodiment, the feeding mechanism (42) reciprocates relative to the housing (34) in the first direction towards the heated chamber (24) and in a second direction, opposite the first direction, away from the heated chamber (24). The feeding mechanism (42) selectively engages the rod (22) such that upon movement of the feeding mechanism (42) in the first direction the rod (22) is gripped by the feeding mechanism (42) and advanced towards the heated chamber (24) with sufficient force to provide the injection pressure. Further, upon movement of the feeding mechanism (42) in the second direction the rod (22) is no longer gripped by the feeding mechanism (42) and the rod (22) does not substantially move in the second direction.

Any conventional reciprocating mechanism or structure able to selectively engage and disengage the rod (22) in the described manner may be used as the feeding mechanism (42). However, in the preferred embodiment, the feeding mechanism (42) comprises a tube (56), located within the housing (34) for reciprocation therein, and a jaw member (57), for camming engagement with the rod (22) and for reciprocation with the tube (56). The size and configuration of the tube (56) are selected to be compatible with the bore (40) of the housing (34). Preferably, the tube (56) is substantially circular on cross-section and the bore (40) of the housing (34) slidably engages at least a portion of the outer surface (58) of the tube (56).

More particularly, the tube (56) comprises a first end (60), a second end (62) and a bore (64) extending from the first end (60) to the second end (62) for receiving the rod (22) therein. As well, referring to FIG. 3, in order to provide access to the rod (22) by the jaw member (57) and in order to permit the actuation of the jaw member (57) as described further below, the housing (34) defines a slot (66) therein. For ease of access and for ease of operation of the apparatus (20), the slot (66) is preferably located on an uppermost surface (68) of the housing (34). Further, although the length of the slot (66) may vary depending upon the desired operation of the feeding mechanism (42), the slot (66) preferably substantially extends from adjacent the first end (60) of the tube (56) to the second end (62) of the tube (56). As a result, when the jaw member (57) extends through the housing (34), the jaw member (57) is permitted to move longitudinally relative to the housing (34) within the slot (66).

Figure 3:
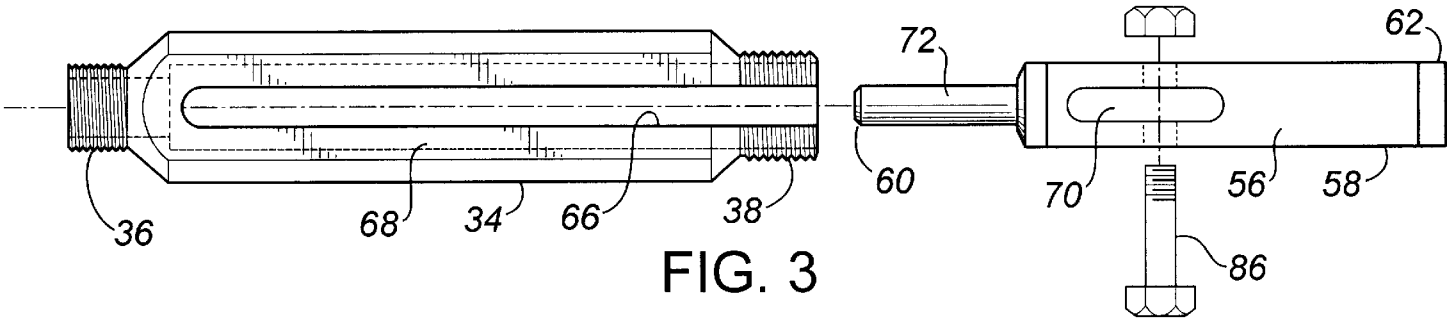
FIG. 3 is an exploded top view of a portion of the preferred embodiment of the apparatus.

Similarly, referring to FIG. 3, in order to further provide access to the rod (22) by the jaw member (57) and in order to permit the actuation of the jaw member (57) as described further below, the tube (56) defines an aperture (70) therein. The aperture (70) permits the passage of the jaw member (57) therethrough and allows the jaw member (57) to function, such that the apparatus (20) is actuated thereby, in the manner described below. Further, the configuration and location of the aperture (70) in the tube (56) are compatible with the configuration and location of the slot (66) in the housing (34) in order that the jaw member may extend from outside the housing (34), through the slot (66) and the aperture (70), for engagement with the rod (22) at the first location.

The rod (22) is substantially supported within the bore (64) of the tube (56) from at least between the first location (26) on the rod (22), at which the advancement force is applied to the rod (22), and the first end (60) of the tube (56). Further, the rod (22) may be substantially supported within the bore (64) substantially between the first and second ends (60, 62) of the tube (56). Thus, in the preferred embodiment, given the configuration of the tube (56) within the housing (34) and the communication between the housing (34) and the heated chamber (24), the rod (22) is substantially supported between at least the first location (26) and the heated chamber (24). Thus, any tendency of the rod (22) to buckle or deform upon the application of the advancement force at the first location by the jaw member (57) is minimized or reduced. As a result, as stated, the desired injection pressure may more readily be produced in the heated chamber (24).

In addition, the tube (56) is comprised of a forward section (72) of reduced cross-sectional diameter, adjacent the first end (60) of the tube (56). Thus, the forward section (72) is not intended to be in sliding engagement with the bore (40) of the housing (34). Rather, the outer diameter of the forward section (72) is sized and shaped to fit within, and slidably engage, the bore (52) of the entry tube (46) at the second end of the entry tube (46). In the preferred embodiment, the bore (52) of the entry tube (46) is enlarged at the second end (50) to accommodate the forward section (72) therein. The thickness of the wall of the forward section (72) is selected such that the rod (22) is substantially supported as it passes from the forward section (72) into the second end (50) of the entry tube (46) at the first end (36) of the housing (34). In other words, the difference between the outer diameter of the forward section (72) and the inner diameter of the bore (50) of the entry tube (52) at the second end (50) is minimized in order to minimize any potential bucking of the rod (22) at this location upon application of the advancement force.

The camming jaw member (57) has an upper end (74), for actuation by an operator such that the camming action of the jaw member (57) may be controlled, and a lower end (76), for passing through the housing (34) and the tube (56) for engagement with the rod (22). The lower end (76) of the jaw member (57) is comprised of a gripping surface (78) and a sliding surface (80). The gripping surface (78) may grip the rod (22) by any conventional means, structure or mechanism. However, preferably, the gripping surface (78) is comprised of a plurality of gripping teeth which are forcibly contacted with the rod (22) upon the camming action of the jaw member (57). Conversely, the sliding surface (80) is preferably smooth such that the sliding surface (80) does not significantly interfere with or impede the movement of the rod (22).

Figure 2:
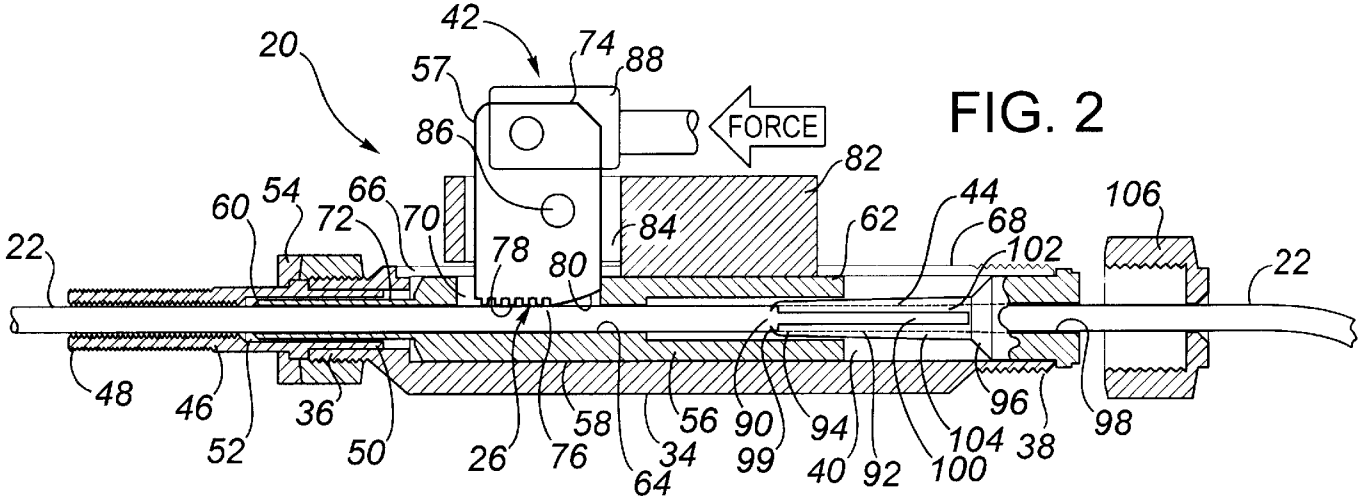
FIG. 2 is a side view of the preferred embodiment of the apparatus shown in longitudinal section, wherein the feeding mechanism of the apparatus is moved in a first direction towards the heated chamber in order to advance the rod.

As shown in FIG. 2, upon the movement of the feeding mechanism (42) in the first direction, involving reciprocation of the tube (56) and the jaw member (57) in the first direction, the camming action of the jaw member (57) causes the gripping surface (78) to grip the rod (22) and thereby apply the advancement force to the rod (22). As a result, the rod (22) is advanced in the first direction towards the heated chamber (24) by the advancement force. As shown in FIG. 1, upon the movement of the feeding mechanism (42) in the second direction, involving reciprocation of the tube (56) and the jaw member (57) in the second direction, the camming action of the jaw member (57) causes the sliding surface (80) to engage the rod (22). As a result, the rod (22) is not substantially moved in the second direction by the feeding mechanism (42).

Figure 4:
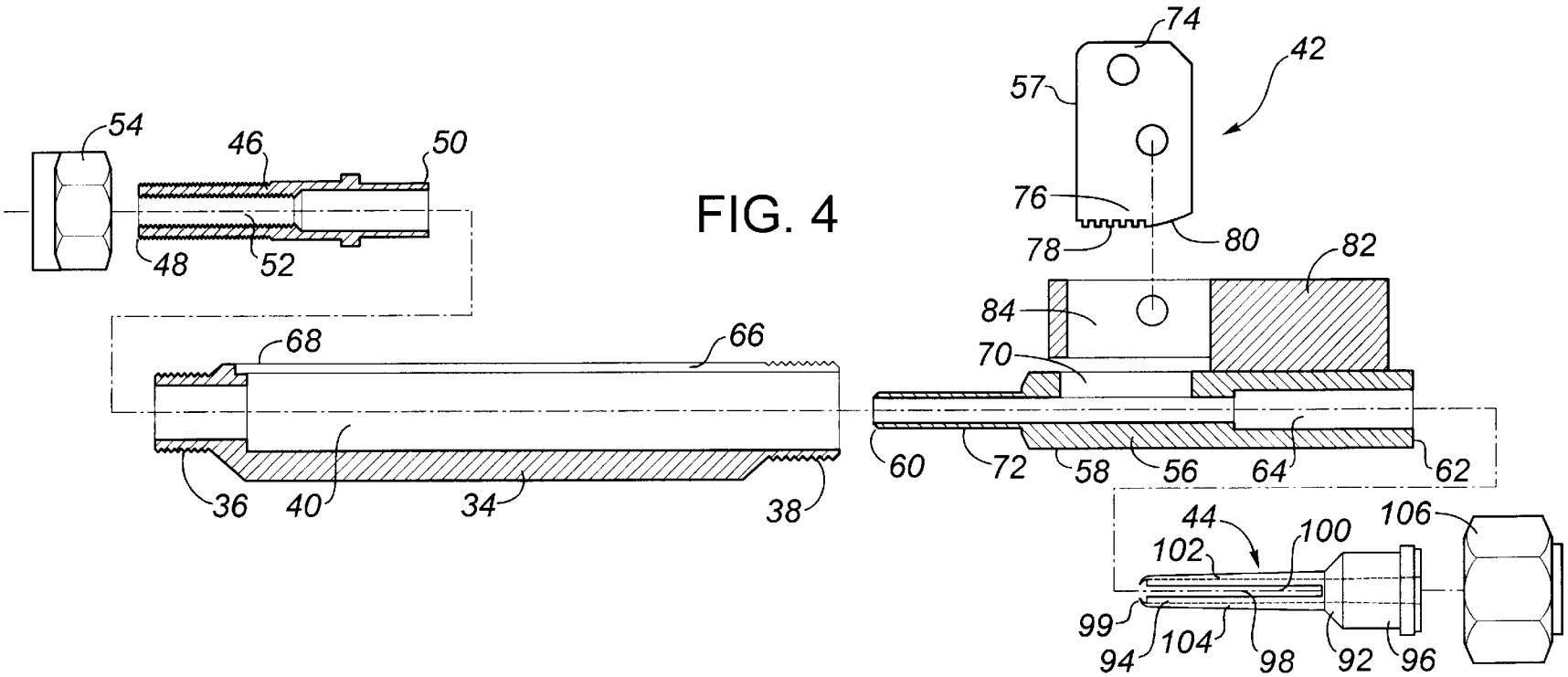
FIG. 4 is an exploded side view of the preferred embodiment of the apparatus shown in longitudinal section.

In order to assist or facilitate the operation of the feeding mechanism (42) and the jaw member (57), the feeding mechanism (42) may be further comprised of a bracket (82). The bracket (82) extends from outside the housing (34), through the slot (66) in the housing (34), for connection or attachment in any conventional manner to the adjacent surface of the tube (56). As shown in FIG. 4, the bracket (82) defines an opening (84) therein for passage of the jaw member (57) therethrough. The opening (84) is aligned with the aperture (70) in the tube (56) so that the jaw member (57) may be inserted through the opening (84) in the bracket (82), the slot (66) in the housing (34) and the aperture (70) in the tube (56) for engagement with the rod (22). The jaw member (57) is then pivotally attached to the bracket (82) by a pivot pin (86) located between the upper and lower ends (74, 76) of the jaw member (57).

Further, a clevis (88) is preferably pivotally connected to the upper end (74) of the jaw member (57) for actuation of the jaw member (57). When a force is applied to the upper end (74) of the jaw member (57) by the clevis (88) in the first direction, the gripping surface (78) grips the rod (22) to move the rod (22) in the first direction, as shown in FIG. 2. When a force is applied to the upper end (74) of the jaw member (57) by the clevis (88) in the second direction, the sliding surface (80) engages the rod (22) such that the rod (22) is not substantially moved by the jaw member (57) in the second direction, as shown in FIG. 1. The clevis (88), and thus the feeding mechanism (42) may be actuated in any conventional manner. For instance, the clevis (88) may be actuated manually, mechanically, pneumatically or hydraulically.

The retaining mechanism (44) of the apparatus (20) is further provided to inhibit the movement of the rod (22) in the second direction. In particular, the retaining mechanism (44) applies a retaining force to the rod (22) at a second location (90) in response to a force applied to the rod (22) in the second direction. The retaining force may be applied to the rod (22) at any desired point or location circumferentially about the rod (22). However, preferably, the retaining mechanism (44) applies the retaining force substantially about the entire circumference of the rod (22) in order to enhance or facilitate the effectiveness of the retaining mechanism (44).

In addition, the second location (90) at which the retaining force is applied may be located at any point longitudinally along the length of the rod (22). However, if the second location (90) is located between the first end (36) of the housing (34) and the first location (26), upon actuation of the feeding mechanism (42) in the first direction, the rod (22) will be pushed through the retaining mechanism (44). As a result, in the event the retaining mechanism (44) fails such that the retaining mechanism (44) will not release the rod (22), movement of the feeding mechanism (42) in the first direction will put the rod (22) under compression which may result in damage to the internal structure of the apparatus (20). Accordingly, the second location (90) is preferably located between the first location (26) and the second end (38) of the housing (34). As a result, upon actuation of the feeding mechanism (42) in the first direction, the rod (22) is pulled through the retaining mechanism (44). In the event the retaining mechanism (44) fails such that it will not release the rod (22), movement of the feeding mechanism (42) in the first direction will put the rod (22) under tension. As a result, although the rod (22) may break, the likelihood of any damage to the internal structure of the apparatus (20) is reduced.

The retaining mechanism (44) may be comprised of any conventional means, structure or device for applying a retaining force to the rod (22) in the described manner. However, in the preferred embodiment, the retaining mechanism (44) is comprised of a tubular member (92). The tubular member (92) has a first end (94), a second end (96) and a bore (98) extending therethrough from the first end (94) to the second end (96). In the preferred embodiment, the tubular member (92) is oriented such that the rod (22) may advance through the tubular member (92) in the first direction from the second end (96) to the first end (94) towards the heated chamber (24).

As indicated above, in the preferred embodiment, the tubular member (92) encompasses substantially the entire circumference of the rod (22) so that the retaining force may be applied about the entire circumference. Further, in the preferred embodiment, the tubular member (92) is inwardly biased, towards the rod (22), such that the rod (22) is received snugly within the bore (98) of the tubular member (92) and such that upon the application of a force to the rod (22) in the second direction, at least the first end (94) of the tubular member (92) exerts a pinching action on the rod (22) in order to provide the retaining force. Thus, as the force is applied in the second direction, the rod (22) is compressed against the portion of the tubular member (92), and in particular the first end (94), exerting the pinching action such that the diameter of the rod (22) is slightly increased. Swelling of the diameter of the rod (22) enhances or facilitates the pinching action of the tubular member (92) such that any movement of the rod (22) in the second direction is further inhibited.

Although any portion of the tubular member (92) may exert the pinching action, the pinching action is preferably exerted by at least the first end (94). Further, in the preferred embodiment, the tubular member (92) is comprised of a forward edge (99) at the first end (94). At least the forward edge (99) of the tubular member (92) exerts the pinching action on the rod (22) in order to provide the retaining force. The forward edge (99) may have any shape or configuration. However, preferably, the forward edge (99) is conical in shape such that a sharpened end or edge is provided thereby.

Any inwardly biased structure or mechanism, able to exert the pinching action as described, may comprise the tubular member (92). However, preferably, the tubular member (92) defines at least one longitudinal slit (100) extending from the first end (94) for a distance towards the second end (96) of the tubular member (92). More preferably, the tubular member (92) defines at least two longitudinal slits (100) extending from the forward edge (99) of the first end (94) towards the second end (96) of the tubular member (92) such that at least two inwardly biased sections are formed at the first end (94) of the tubular member (92) for exerting the pinching action. In the preferred embodiment, two longitudinal slits (100) are defined by the tubular member (92) such that a first inwardly biased section (102) and a second inwardly biased section (104) are formed thereby. The first and second inwardly biased sections (102, 104) substantially encompass the rod (22) received therebetween. Accordingly, the forward edges (99) of each section (102, 104) act together to exert the pinching action substantially about the entire circumference of the rod (22).

The retaining mechanism (44) may be aligned with the housing (34), and associated with it, in any manner or configuration permitting the operation of the retaining mechanism (44) as described herein. However, preferably, the bore (98) of the tubular member (92) is substantially coaxial with the bore (40) of the housing (34). In the preferred embodiment in which the tube (56) is located within the housing (34), the bore (98) of the tubular member (92) is also substantially coaxial with the bore (64) of the tube (56).

Further, preferably, at least the first end (94) of the tubular member (92) extends into the bore (40) of the housing (34) at the second end (38) of the housing (34). In the preferred embodiment, the entire tubular member (92) is located within the housing (34) adjacent the second end (38) of the housing (34). Further, in the preferred embodiment in which the tube (56) is located within the housing (34), the first end (94) of the tubular member (92) extends into the bore (64) of the tube (56) at its second end (62). The second end (96) of the tubular member (92) extends outside of the tube (56) for connection or affixation to the housing (34) adjacent the second end (38) of the housing (34). The connection between the tubular member (92) and the housing (34) may be secured by any conventional mechanism, structure or device capable of making the necessary connection. However, in the preferred embodiment, the tubular member (92) is secured to the housing (34) by a retaining nut (106).

The outer diameter of the first end (94) of the tubular member (92) is sized and shaped to fit within, and slidably engage, the bore (64) of the tube (56) at the second end (62) of the tube (56). In the preferred embodiment, the bore (64) of the tube (56) is enlarged at the second end (62) to accommodate the first end (94) of the tubular member (92) therein. The thickness of the wall of the first end (94) of the tubular member (92) is selected such that the rod (22) is substantially supported as it passes from the bore (98) of the tubular member (92) at the first end (94) into the bore (64) of the tube (56) at the second end (62). In other words, the difference between the outer diameter of the first end (94) of the tubular member (92) and the inner diameter of the bore (64) of the tube (56) at the second end (62) is minimized in order to minimize any potential bucking of the rod (22) at this location upon application of the advancement force.

In operation, upon the reciprocation of the tube (56) within the housing (34) in the first direction as shown in FIG. 2, the position of the tubular member (92) relative to the housing (34) is maintained. As a result, the rod (22) is pulled through the tubular member (92) by the application of the advancement force to the rod (22) and the rod (22) is thereby advanced in the first direction. Upon reciprocation of the tube (56) within the housing (34) in the second direction as shown in FIG. 1, the tubular member (92) applies the retaining force to the rod (22) to inhibit any movement of the rod (22) in the second direction.

In summary, the preferred embodiment of the within invention provides a relatively simple apparatus (20) which is relatively easy to operate, as compared to conventional devices performing the same or a similar function. Further, given the relative simplicity of the design, the apparatus (20) tends to be economical to both manufacture and maintain.

The embodiments of the invention in which an exclusive privilege or property is claimed are defined as follows:

1. An apparatus for advancing a rod comprised of a thermoplastic material to a heated chamber for injection therefrom under pressure, the apparatus comprising:

(a) a housing for receiving the rod having a first end for communication with the heated chamber, a second end and a bore extending therethrough from the first end to the second end;

(b) a feeding mechanism for selectively engaging the rod within the housing such that an advancement force is applied to the rod at a first location in a first direction towards the heated chamber in order to advance the rod in the first direction, wherein the advancement force is sufficient to provide an injection pressure within the heated chamber and wherein the feeding mechanism extends within the housing substantially between at least the first location and the first end of the housing and defines a bore extending therebetween for receiving the rod such that the rod is substantially supported within the bore of the feeding mechanism; and (c) a retaining mechanism, associated with the housing, for inhibiting the movement of the rod in a second direction opposite the first direction, wherein the retaining mechanism applies a retaining force to the rod at a second location substantially about the entire circumference of the rod in response to a force applied to the rod in the second direction.

2. The apparatus as claimed in claim 1 further comprising an entry tube having a first end for connection with the heated chamber and a second end for connection with the first end of the housing, wherein the entry tube defines a bore between the first end and the second end of the entry tube for receiving the rod such that the rod is substantially supported within the bore of the entry tube between the first end of the housing and the heated chamber.

3. The apparatus as claimed in claim 2 wherein the retaining mechanism is comprised of a tubular member having a first end, a second end and a bore extending therethrough for receiving the rod, wherein the rod is permitted to advance through the tubular member in the first direction from the second end to the first end towards the heated chamber upon the application of the advancement force to the rod and wherein the tubular member applies the retaining force to the rod in response to a force applied to the rod in the second direction.

4. The apparatus as claimed in claim 3 wherein the tubular member defines at least one longitudinal slit extending from the first end towards the second end of the tubular member, and wherein the tubular member encompasses substantially the entire circumference of the rod and is inwardly biased such that the rod is received snugly within the bore of the tubular member, and such that upon the application of a force to the rod in the second direction, at least the first end of the tubular member exerts a pinching action on the rod in order to provide the retaining force.

5. The apparatus as claimed in claim 4 wherein the tubular member defines at least two longitudinal slits extending from the first end towards the second end of the tubular member such that at least two inwardly biased sections are formed at the first end of the tubular member for exerting the pinching action.

6. The apparatus as claimed in claim 5 wherein the first end of the tubular member is comprised of a forward edge, and wherein the forward edge exerts the pinching action on the rod in order to provide the retaining force.

7. The apparatus as claimed in claim 4 wherein the feeding mechanism applies the advancement force to the rod at the first location between the first and second ends of the housing and wherein the retaining mechanism applies the retaining force to the rod at a second location between the first location and the second end of the housing in response to a force applied to the rod in the second direction.

8. The apparatus as claimed in claim 7 wherein the bore of the retaining mechanism is substantially coaxial with the bore of the housing.

9. The apparatus as claimed in claim 8 wherein at least the first end of the tubular member extends into the bore of the housing at the second end of the housing.

10. The apparatus as claimed in claim 2 wherein the advancement force provides an injection pressure within the heated chamber of greater than about 1000 psi.

11. The apparatus as claimed in claim 10 wherein the advancement force provides an injection pressure within the heated chamber of equal to or greater than about 2500 psi.

12. The apparatus as claimed in claim 2 wherein the feeding mechanism reciprocates relative to the housing in the first direction towards the heated chamber and in the second direction away from the heated chamber and wherein the feeding mechanism selectively engages the rod such that upon movement of the feeding mechanism in the first direction the rod is gripped by the feeding mechanism and advanced towards the heated chamber with sufficient force to provide the injection pressure and such that upon movement of the feeding mechanism in the second direction the retaining mechanism applies the retaining force to the rod such that the rod does not substantially move in the second direction.

13. The apparatus as claimed in claim 12 wherein the feeding mechanism comprises:

(a) a tube located within the housing for reciprocation within the housing, the tube comprising a first end, a second end and a bore extending from the first end to the second end of the tube for receiving the rod such that the rod is substantially supported within the bore from at least the first location on the rod to the first end of the tube; and (b) a jaw member comprising a gripping surface and a sliding surface, for camming engagement with the rod and for reciprocation with the tube such that the rod is gripped by the gripping surface as the feeding mechanism is moved in the first direction and such that the rod is engaged by the sliding surface as the feeding mechanism is moved in the second direction.

14. An apparatus for advancing a rod comprised of a thermoplastic material to a heated chamber for injection therefrom under pressure, the apparatus comprising:

(a) a housing for receiving the rod having a first end for communication with the heated chamber, a second end and a bore extending therethrough from the first end to the second end;

(b) a feeding mechanism for selectively engaging the rod within the housing at a first location between the first and second ends of the housing such that an advancement force is applied to the rod at the first location in a first direction towards the heated chamber in order to advance the rod in the first direction, wherein the advancement force is sufficient to provide an injection pressure within the heated chamber and wherein the feeding mechanism extends within the housing substantially between at least the first location and the first end of the housing and defines a bore extending therebetween for closely receiving the rod such that the rod is substantially supported within the bore of the feeding mechanism; and (c) a retaining mechanism, associated with the housing, for inhibiting the movement of the rod in a second direction opposite the first direction, wherein the retaining mechanism applies a retaining force to the rod at a second location between the first location and the second end of the housing in response to a force applied to the rod in the second direction.

15. The apparatus as claimed in claim 14 further comprising an entry tube having a first end for connection with the heated chamber and a second end for connection with the first end of the housing, wherein the entry tube defines a bore between the first end and the second end of the entry tube for closely receiving the rod such that the rod is substantially supported within the bore of the entry tube between the first end of the housing and the heated chamber.

16. The apparatus as claimed in claim 15 wherein the retaining mechanism is comprised of a tubular member having a first end, a second end and a bore extending therethrough for receiving the rod, wherein the rod is permitted to advance through the tubular member in the first direction from the second end to the first end towards the heated chamber upon the application of the advancement force to the rod and wherein the tubular member applies the retaining force to the rod in response to a force applied to the rod in the second direction.

17. The apparatus as claimed in claim 16 wherein the tubular member defines at least one longitudinal slit extending from the first end towards the second end of the tubular member, and wherein the tubular member is inwardly biased such that the rod is received snugly within the bore of the tubular member, and such that upon the application of a force to the rod in the second direction, at least the first end of the tubular member exerts a pinching action on the rod in order to provide the retaining force.

18. The apparatus as claimed in claim 17 wherein the tubular member defines at least two longitudinal slits extending from the first end towards the second end of the tubular member such that at least two inwardly biased sections are formed at the first end of the tubular member for exerting the pinching action.

19. The apparatus as claimed in claim 18 wherein the first end of the tubular member is comprised of a forward edge, and wherein the forward edge exerts the pinching action on the rod in order to provide the retaining force.

20. The apparatus as claimed in claim 17 wherein the tubular member encompasses substantially the entire circumference of the rod such that the retaining force is applied to the rod substantially about the entire circumference of the rod.

21. The apparatus as claimed in claim 20 wherein the bore of the retaining mechanism is substantially coaxial with the bore of the housing.

22. The apparatus as claimed in claim 21 wherein at least the first end of the tubular member extends into the bore of the housing at the second end of the housing.

23. The apparatus as claimed in claim 15 wherein the advancement force provides an injection pressure within the heated chamber of greater than about 1000 psi.

24. The apparatus as claimed in claim 23 wherein the advancement force provides an injection pressure within the heated chamber of equal to or greater than about 2500 psi.

25. The apparatus as claimed in claim 15 wherein the feeding mechanism reciprocates relative to the housing in the first direction towards the heated chamber and in the second direction away from the heated chamber and wherein the feeding mechanism selectively engages the rod such that upon movement of the feeding mechanism in the first direction the rod is gripped by the feeding mechanism and advanced towards the heated chamber with sufficient force to provide the injection pressure and such that up on movement of the feeding mechanism in the second direction the retaining mechanism applies the retaining force to the rod such that the rod does not substantially move in the second direction.

26. The apparatus as claimed in claim 25 wherein the feeding mechanism comprises:

(a) a tube located within the housing for reciprocation within the housing, the tube comprising a first end, a second end and a bore extending from the first end to the second end of the tube for receiving the rod such that the rod is substantially supported within the bore from at least the first location on the rod to the first end of the tube; and (b) a jaw member comprising a gripping surface and a sliding surface, for camming engagement with the rod and for reciprocation with the tube such that the rod is gripped by the gripping surface as the feeding mechanism is moved in the first direction and such that the rod is engaged by the sliding surface as the feeding mechanism is moved in the second direction.

* * * * *